US007735517B2

(12) United States Patent
Kerckhove et al.

(10) Patent No.: US 7,735,517 B2
(45) Date of Patent: Jun. 15, 2010

(54) ROTARY-ACTUATED ELECTRO-HYDRAULIC VALVE

(75) Inventors: Philippe Georges Vande Kerckhove, Naperville, IL (US); Pengfei Ma, Naperville, IL (US)

(73) Assignee: Caterpillar Inc, Peoria, IL (US)

( * ) Notice: Subject to any disclaimer, the term of this patent is extended or adjusted under 35 U.S.C. 154(b) by 731 days.

(21) Appl. No.: 11/643,818

(22) Filed: Dec. 22, 2006

(65) Prior Publication Data

US 2008/0149181 A1 Jun. 26, 2008

(51) Int. Cl.
*F15B 13/043* (2006.01)

(52) U.S. Cl. ..... 137/625.63; 137/625.6; 137/625.64; 251/31

(58) Field of Classification Search ..... 137/625.6, 137/625.63, 625.64; 251/30.01, 31
See application file for complete search history.

(56) References Cited

U.S. PATENT DOCUMENTS

| | | | | |
|---|---|---|---|---|
| 123,174 | A * | 1/1872 | Hopkins | 137/625.63 |
| 3,106,224 | A | 10/1963 | Moss et al. | |
| 3,548,876 | A * | 12/1970 | Blok et al. | 137/625.63 |
| 3,665,807 | A * | 5/1972 | Bartholomaus et al. | 91/378 |
| 4,245,547 | A | 1/1981 | Reynolds | |
| 4,262,969 | A | 4/1981 | Chatterjea | |
| 4,545,409 | A * | 10/1985 | Luhmer | 137/625.64 |
| 4,674,539 | A * | 6/1987 | Sloate | 137/625.64 |
| 4,683,915 | A | 8/1987 | Sloate | |
| 4,766,926 | A | 8/1988 | Smith | |
| 4,779,648 | A | 10/1988 | Sloate | |
| 4,803,415 | A | 2/1989 | Sepesy | |
| 4,887,632 | A | 12/1989 | Tanaka et al. | |

FOREIGN PATENT DOCUMENTS

| | | |
|---|---|---|
| EP | 0 088 017 | 9/1983 |
| JP | 63 001802 | 1/1988 |
| JP | 05 017970 | 1/1993 |
| JP | 06241207 A | 8/1994 |
| JP | 2003278703 A | 10/2003 |

OTHER PUBLICATIONS

English-language Abstract of JP 06241207 A.
English-language Abstract of JP 2003278703 A.

* cited by examiner

*Primary Examiner*—John Rivell
(74) *Attorney, Agent, or Firm*—Finnegan, Henderson, Farabow, Garrett & Dunner

(57) ABSTRACT

A valve for controlling fluid flow in a fluid system is disclosed. The valve includes a housing, a servo spool, and a piston. The servo spool defines a spiral groove and a spiral land. The piston defines an orifice configured to provide flow communication to a supply of pressurized fluid and an orifice configured to provide flow communication to a portion of the fluid system exterior to the valve. The valve further includes a main spool operably coupled to the piston. The main spool is configured to control flow of fluid in the fluid system. The spiral groove and spiral land are configured such that angular displacement of the servo spool results in a force imbalance on the piston, thereby moving the piston and the main spool in one of a first direction and a second direction.

17 Claims, 3 Drawing Sheets

ROTARY-ACTUATED ELECTRO-HYDRAULIC VALVE

TECHNICAL FIELD

The present disclosure is related to a valve for controlling fluid flow and, more particularly, to a rotary-actuated electro-hydraulic valve.

BACKGROUND

Hydraulic systems may include one or more valves for controlling the flow of hydraulic fluid to one or more fluid-operated devices. For example, a machine may include one or more fluid-operated actuators that may be controlled by the hydraulic system for performing work. A valve may include a cylinder and spool within the cylinder. The spool and cylinder may be configured such that movement of the spool within the cylinder opens and closes fluid passages. The opening and closing of the fluid passages may be selectively controlled to control the flow of fluid to one or more fluid-operated devices, such as, for example, hydraulic actuators.

Conventional valves may suffer from a number of drawbacks. For example, some conventional valves may suffer from slow response, which may impair an operator's use of an actuator controlled by the valve. Further, some conventional valves may suffer from a lack of resolution in response to an operator's commands, resulting in the possible impairment of an operator's ability to accurately control movement of an actuator. Another possible drawback with some conventional valves relates to inconsistent operation. For example, some conventional electro-hydraulic valves suffer from hysteresis, or the inconsistent positioning of the spool within the cylinder with respect to movement of an operator's control device. Further, the operation of some conventional valves may be adversely affected by contamination of the fluid flowing through the valve.

Thus, it may be desirable to control fluid flow in a hydraulic circuit using a valve that is more responsive to an operator's commands. Further, it may be desirable to control fluid flow in a hydraulic system using a valve that exhibits consistent operation. Moreover, it may be desirable to control fluid flow in a hydraulic system using a valve that is less sensitive to contamination.

One example of a pilot controlled valve is described in U.S. Pat. No. 4,683,915 ("the '915 patent") issued to Sloate on Aug. 4, 1987. The '915 patent describes a pilot controlled valve having the valve body provided with a cylindrical bore and first and second radial bores on opposite sides of a land on the valve body. The valve body is slidable within an axial bore of a valve housing. The valve housing is provided with a pressure inlet port, at least one service port, and at least one pressure return port, which are axially spaced. In a central position of the valve housing, a land of the valve body isolates the pressure inlet port from the pressure return port and/or the service port, one of the radial bores is in fluid communication with the pressure inlet port, and the other radial bore is in fluid communication with either a pressure return port or service port. A rotatable control rod is positioned within the cylindrical bore of the valve body. The control rod is shaped to selectively open or close the radial bores to create a pressure imbalance across the valve body, thereby causing the valve body to shift in an axial direction.

Although the pilot controlled valve described in the '915 patent may reduce the sensitivity of the valve to contamination, the valve described in the '915 patent does not necessarily provide a valve that increases responsiveness and resolution in response to an operator's commands.

The exemplary valves disclosed herein may be directed to achieving one or more of the desires set forth above.

SUMMARY OF THE INVENTION

In one aspect, the present disclosure includes a valve for controlling fluid flow in a fluid system. The valve includes a housing and a servo spool positioned at least partially within the housing. The servo spool includes a substantially cylindrical portion, and the substantially cylindrical portion defines a spiral groove extending around the substantially cylindrical portion to define a spiral land. The valve further includes a piston positioned at least partially within the housing and at least partially surrounding the substantially cylindrical portion of the servo spool. The piston defines an orifice configured to provide flow communication to a supply of pressurized fluid and an orifice configured to provide flow communication to a portion of the fluid system exterior to the valve. The valve also includes a main spool operably coupled to the piston. The main spool is configured to control flow of fluid in the fluid system. The valve further includes a first chamber at least partially defined by at least one of the housing, the servo spool, and the piston, and a second chamber at least partially defined by at least one of the housing, the servo spool, and the piston. The first chamber is located such that force due to fluid pressure in the first chamber is configured to move the piston in a first direction, and the second chamber is located such that force due to fluid pressure in the second chamber is configured to move the piston in a second direction. The spiral groove and spiral land are configured such that angular displacement of the servo spool results in providing flow communication between the first chamber and the portion of the fluid system exterior to the valve via one of the orifices and between the supply of pressurized fluid and the second chamber via another of the orifices, such that fluid pressure in the first chamber is changed and fluid pressure in the second chamber is changed, resulting in a force imbalance on the piston, thereby moving the piston and the main spool in one of the first direction and the second direction.

According to another aspect, the disclosure includes a hydraulic system including a fluid pump configured to pressurize in the hydraulic system, and an actuator configured to operate in response to receipt of pressurized fluid. The hydraulic system further includes a valve including a housing and a servo spool positioned at least partially within the housing. The servo spool includes a substantially cylindrical portion, and the substantially cylindrical portion defines a spiral groove extending around the substantially cylindrical portion to define a spiral land. The valve further includes a piston positioned at least partially within the housing and at least partially surrounding the substantially cylindrical portion of the servo spool. The piston defines an orifice configured to provide flow communication to a supply of pressurized fluid and an orifice configured to provide flow communication to a portion of the hydraulic system exterior to the valve. The valve also includes a main spool operably coupled to the piston. The main spool is configured to control flow of fluid to the actuator. The valve further includes a first chamber at least partially defined by at least one of the housing, the servo spool, and the piston, and a second chamber at least partially defined by at least one of the housing, the servo spool, and the piston. The first chamber is located such that force due to-fluid pressure in the first chamber is configured to move the piston in a first direction, and the second chamber is located such that force due to fluid pressure in the second chamber is configured to move the piston in a second direction. The spiral groove and spiral land are configured such that angular displacement of the servo spool results in providing flow communication between the first chamber and the portion of the fluid system exterior to the valve via one of the orifices and between the supply of pressurized fluid and the second chamber via another of the orifices, such that fluid pressure in the first chamber is changed and fluid pressure in the second chamber is changed, resulting in a force imbalance on the piston, thereby moving the piston and the main spool in one of the first direction and the second direction.

According to a further aspect, the disclosure includes a method for controlling fluid flow in a hydraulic system. The method includes providing a valve including a housing at least partially housing a servo spool and a piston. The housing, servo spool, and piston define a first chamber and a second chamber in flow communication with the fluid flow. The servo spool defines a spiral groove and a spiral land, and the piston defines an orifice configured to provide flow communication between the fluid flow and the first chamber and an orifice configured to provide flow communication between the fluid flow and the second chamber. The method further includes controlling the fluid flow in the hydraulic system by angularly displacing the servo spool such that the spiral groove provides flow communication between the first chamber and the hydraulic system and flow communication between the second chamber and the hydraulic system, resulting in a pressure drop in one of the first chamber and the second chamber and a pressure increase in another of the first chamber and the second chamber.

DETAILED DESCRIPTION

Figure 1:
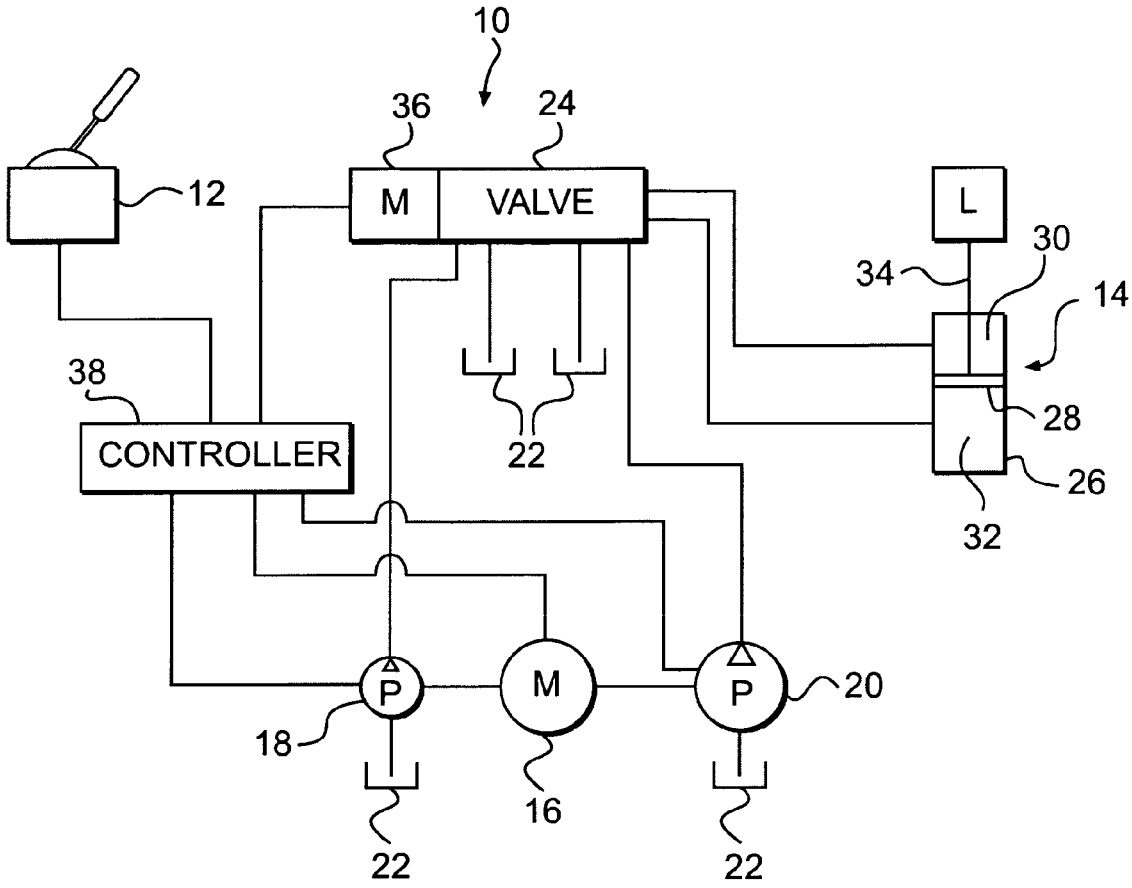
FIG. 1 is a schematic block diagram of an exemplary embodiment of a hydraulic system.

FIG. 1 schematically illustrates an exemplary embodiment of a hydraulic system 10. System 10 may include a control device 12 configured to control operation of at least one aspect of system 10, for example, a hydraulic actuator 14. System 10 may be incorporated into a machine, such as, for example, a construction vehicle having one or more work implements configured to be operated via one or more actuators 14.

According to some embodiments, system 10 may include a power source 16, such as an internal combustion engine (e.g., a compression-ignition engine, a spark-ignition engine, or a gas turbine engine), or a motor (e.g., an electric motor). Power source 16 may be configured to supply power to, for example, a pilot pump 18 and/or a main pump 20. For example, pilot pump 18 and/or main pump 20 may be configured to draw fluid from a tank 22, which serves as a reservoir for the system 10, and pump the fluid under pressure (e.g., as a pilot supply and a main supply, respectively) to various portions of system 10. Pilot pump 18 and/or main pump 20 may be fixed-displacement pumps, variable-displacement pumps, or a combination of fixed-displacement pumps and variable-displacement pumps. According to some embodiments, rather than, or in addition to, providing a pilot supply via pilot pump 18, pilot supply may be supplied via main pump 20 and a pressure reducing valve.

System 10 further includes a valve 24 configured to control the flow of fluid to and/or from actuator 14. For example, actuator 14 may include a cylinder 26 and a piston 28. Piston 28 defines a rod chamber 30 and a head chamber 32, and piston 28 may be coupled to a rod 34 that is coupled to a load L, for example, a boom or bucket of a machine configured to perform work. Valve 24 may be configured to control the flow of fluid into and/or from rod chamber 30 and/or head chamber 32, such that rod 34 extends from actuator 14 and retracts into actuator 14. According to some embodiments, actuator 14 may be a hydraulic motor or any other hydraulic actuator known to a person having skill in the art.

According to some embodiments, valve 24 may include a motor 36 configured to control operation of valve 24. For example, pilot pump 18 may provide a pilot supply of fluid to a pilot portion of valve 24, and main pump 20 may supply fluid to a main portion of valve 24, which is controlled by the pilot portion of valve 24. According to some embodiments, motor 36 operates to control the flow of the pilot supply in valve 24, such that the main portion of valve 24 supplies a desired fluid flow from main pump 20 to actuator 14. For example, to extend rod 34, the pilot supply is controlled by the pilot portion of valve 24, such that the main portion of valve 24 operates to supply pressurized fluid to head chamber 32, thereby moving piston 28 to extend rod 34. Fluid in rod chamber 30 is forced back to valve 24, where it may be exhausted to tank 22 and/or diverted to supply fluid to head chamber 32 and/or another part of system 10, for example, according to a regeneration strategy. To retract rod 34, the pilot supply is controlled by the pilot portion of valve 24, such that the main portion of valve 24 operates to supply pressurized fluid to rod chamber 30, thereby moving piston 28 to retract rod 34. Fluid in head chamber 32 is forced back to valve 24, where it may be exhausted to tank 22 and/or diverted to supply fluid to head chamber 32 and/or another part of system 10, for example, according to a regeneration strategy.

According to some embodiments, system 10 may include a controller 38 configured to at least partially control operation of system 10 according to operation of control device 12. For example, controller 38 may include electronic circuits and/or hydro-mechanical circuits for controlling fluid flow in system 10. Controller 10 may be operably coupled to one or more of control device 12, power source 16, pilot pump 18, main pump 20, and/or motor 36, such that actuator 14 responds according to an operator's input from control device 12.

Figure 2:
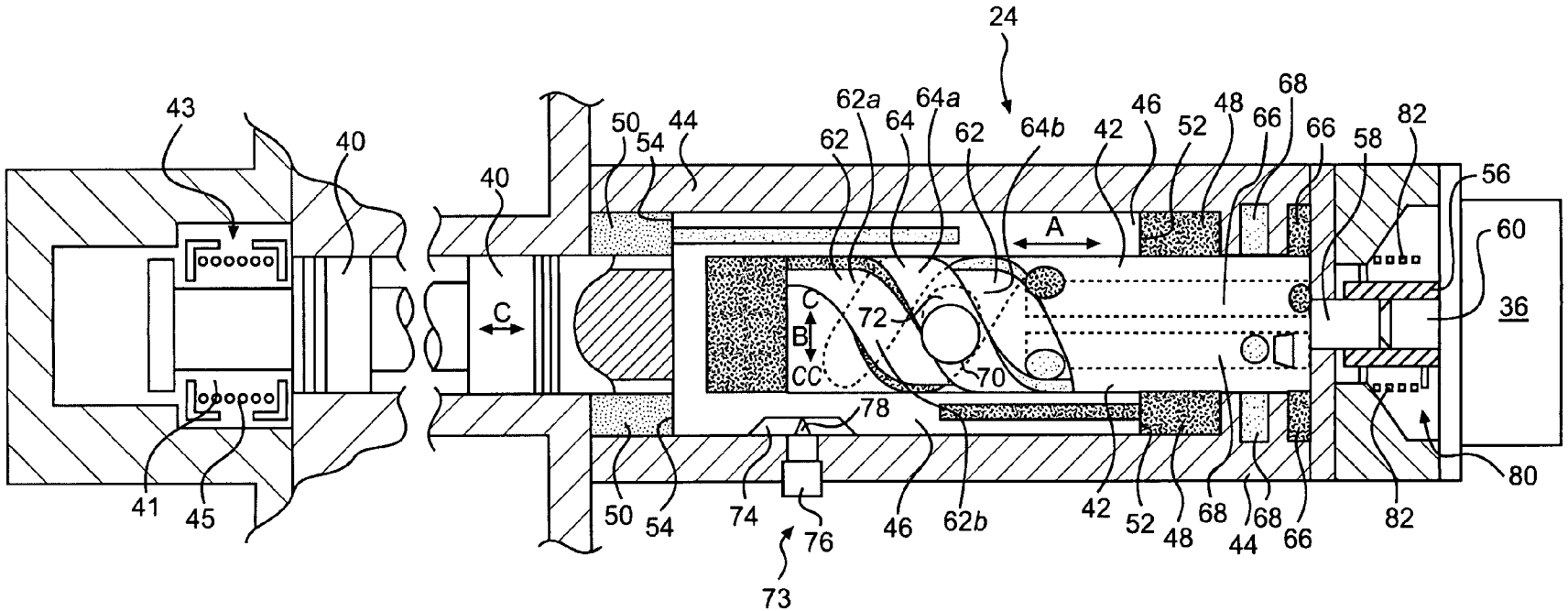
FIG. 2 is a schematic, partial section view of an exemplary embodiment of a valve.

FIG. 2 illustrates an exemplary embodiment of valve 24. According to some embodiments, valve 24 may be a rotary-actuated electro-hydraulic valve. For example, FIG. 2 schematically depicts a portion of an electro-hydraulic valve 24 for use in a hydraulic system 10, which includes, for example, one or more hydraulic actuators 14. The exemplary electro-hydraulic valve 24 includes a main spool 40 controlled by operation of a servo spool 42. According to some embodiments, main spool 40 is operably associated with a main spool chamber 41, and the position of main spool 40 may be biased via a bias assembly 43, including a spring 45. Servo spool 42 is in flow communication with a pilot supply and a drain to tank 22. Valve 24 includes a housing 44, and housing 44 at least partially houses a piston 46 and servo spool 42. Servo spool 42, piston 46, and housing 44 define a first chamber 48 (e.g., an annular chamber) and a second chamber 50 (e.g., an annular chamber) located at opposite ends of piston 46. Fluid pressure in first chamber 48 acts on surface 52 of piston 46, and fluid pressure in second chamber 50 acts on surface 54 of piston 46, such that the forces applied to each surface 52 and 54 of piston 46 tend to oppose one another. As the force due to fluid pressure in first chamber 48 changes and the force due to fluid pressure in second chamber 50 changes, piston 46 translates within housing 44 (i.e., to the left and right, as shown by arrow A in FIG. 2) until the pressure in first chamber 48 and the pressure in second chamber 50 result in piston 46 not translating within housing 44 (e.g., the pressure in first chamber 48 and the pressure in second chamber 50 equal one another when the area of surface 52 of piston 46 equals the area of surface 54 of piston 46, or when a pressure difference between first chamber 48 and second chamber 50 balances a spring force provided by spring 45 associated with main spool 40). Piston 46 is operably coupled to main spool 40 (e.g., piston 46 is rigidly coupled to main spool 40 to form a unitary structure), such that movement of piston 46 causes main spool 40 to move in a corresponding manner. According to some embodiments, movement of main spool 40 may control the flow of fluid to and/or from hydraulic actuator 14, for example, as outlined previously with respect to the exemplary embodiment of hydraulic system 10 schematically depicted in FIG. 1.

Movement of piston 46 may be controlled by operation of servo spool 42, which controls the difference between the pressure in first chamber 48 and the pressure in second chamber 50. Servo spool 42 may be operably coupled to motor 36, for example, a step motor, via a coupling 56 (e.g., an elastic coupling), such that servo spool 42 may be rotated through an angular displacement within piston 46 via the motor 36. For example, servo spool 42 may include an input shaft 58, and motor 36 may include an output shaft 60, and input shaft 58 of servo spool 42 may be coupled directly to output shaft 60 of motor 36 via coupling 56. According to some embodiments (not shown) a gear assembly, for example, a reduction gear assembly, may be provided between motor 36 and servo spool 42.

According to some embodiments, servo spool 42 includes one or more spiral grooves 62 defining one or more spiral lands 64. For example, spiral grooves 62*a* and 62*b* located on opposite sides of servo spool 42 provide flow communication with at least one passage 66 to a pilot supply and at least one passage 68 to drain to tank 22. (As schematically depicted in FIG. 2, spiral groove 62*a* is shown on the front side of servo spool 42, and spiral groove 62*b* is represented by hidden lines showing the back side of servo spool 42.) According to some embodiments, passage 66 and/or passage 68 may be internal to servo spool 42 in the form of, for example, one or more bores extending lengthwise within servo spool 42. Piston 46 includes an orifice 70 providing flow communication to first chamber 48 and providing flow communication (e.g., permanent flow communication) to a pilot supply, and an orifice 72 (e.g., an orifice diametrically-opposed to orifice 70) providing flow communication (e.g., permanent flow communication) to second chamber 50 and to a reference pressure (e.g., drain to tank 22).

During exemplary operation, when servo spool 42 is in a neutral position (i.e., a position resulting in no movement of piston 46 and/or main spool 40), spiral lands 64*a* and 64*b* cover orifices 70 and 72, respectively, of piston 46. (As schematically depicted in FIG. 2, spiral land 64*a* is shown on the front side of servo spool 42, and spiral land 64*b* is represented by hidden lines showing the back side of servo spool 42.) In the neutral position, for example, the force acting on surface 52 of piston 46 due to the pressure in first chamber 48 is substantially equal to the force acting on surface 54 of piston 46 due to the pressure in second chamber 50. As servo spool 42 rotates (e.g., in a clockwise direction as viewed from the motor-end of valve 24 of FIG. 2, as shown by direction C of arrow B), orifices 70 and 72 become increasingly uncovered as spiral lands 64*a* and 64*b* of servo spool 42 move to the right (as depicted in FIG. 2), such that spiral grooves 62*a* and 62*b* permit flow communication between the pilot supply and second chamber 50, and between first chamber 48 and a reference pressure (e.g., a drain to tank 22). This causes the pressure in second chamber 50 to increase and the pressure in first chamber 48 to decrease. The difference in pressure between the pressure in second chamber 50 and the pressure in first chamber 48 causes piston 46 to move to the right (as shown in FIG. 2). As piston 46 moves to the right, main spool 40, which is operably coupled to piston 46, also moves to the right (as shown by the right end of arrow C), thereby controlling fluid flow to and/or from, for example, actuator 14 that is part of a hydraulic system, such as, for example, system 10. The rightward movement of piston 46 continues until orifices 70 and 72 in piston 46 are covered again by spiral lands 64*a* and 64*b* of servo spool 42, as piston 46 moves to the right due to the difference between the pressure in second chamber 50 and the pressure in first chamber 48.

As servo spool 42 rotates in a counterclockwise direction (i.e., as viewed from the motor-end of valve 24 of FIG. 2, as shown by direction CC of arrow B), orifices 70 and 72 become increasingly uncovered as spiral lands 64*a* and 64*b* of servo spool 42 move to the left (as depicted in FIG. 2), such that spiral grooves 62*a* and 62*b* permit flow communication between the pilot supply and first chamber 48, and between second chamber 50 and a reference pressure (e.g., a drain to tank 22). This causes the pressure in first chamber 48 to increase and the pressure in second chamber 50 to decrease. The difference in pressure between the pressure in second chamber 50 and the pressure in first chamber 48 causes piston 46 to move to the left (as shown in FIG. 2). As piston 46 moves to the left, main spool 40, which is operably coupled to piston 46, also moves to the left (as shown by direction of the left end of arrow C), thereby controlling fluid flow to and/or from, for example, actuator 14 that is part of a hydraulic system. The leftward movement of piston 46 continues until orifices 70 and 72 in piston 46 are covered again by spiral lands 64*a* and 64*b* of servo spool 42, as piston 46 moves to the left due to the difference between the pressure in second chamber 50 and the pressure in first chamber 48.

According to some embodiments, motor 36 of electro-hydraulic valve 24 may be a step motor. For example, step motor 36 may be configured to operate such that the amount of rotation of output shaft 60 occurs in finite increments, thereby rotating servo spool 42 in corresponding finite increments of angular displacement. For example, step motor 36 may operate to rotate output shaft 60 in increments of, for example, about 1.8 degrees for each step of step motor 36, which, in turn, rotates servo spool 42 in corresponding 1.8 degree-increments, such that main spool 40 moves linearly in corresponding finite increments, for example, once main spool 40 achieves a steady state position corresponding to the incremental rotation of servo spool 42. According to some embodiments, the angular displacement of servo spool 42 may not necessarily equal the angular displacement of motor 36, for example, if motor 36 and servo spool 42 are operably coupled via a reduction gear assembly.

According to some embodiments, motor 36 may be operated according to a dithering strategy, which may serve to increase the resolution of the movement of main spool 40. According to an exemplary embodiment of the dithering strategy, step motor 36 may be advanced and returned quickly between two adjacent angular incremental movements of step motor 36 in a repeated fashion, such that servo spool 42 rotates back and forth quickly between two corresponding angular incremental positions. The response of piston 46 may be slower than the response of step motor 36's repeated reversals of incremental movement, such that piston 46 may be positioned at a location in housing 44 between steady state positions of piston 46 corresponding to adjacent angular incremental steps of step motor 36. This exemplary operation of step motor 36 may result in more resolution in response to an operator's control (i.e., providing finer steps of adjustment) of main spool 40, which may improve the resolution and/or accuracy of main spool 40's movement. This may provide an operator with more accurate control of an actuator operated by valve 24.

Some embodiments may include an assembly 73 for preventing main spool 40 and/or piston 46 from rotating with servo spool 42. For example, assembly 73 may include a groove 74 for receiving a pin 76 that extends through a wall of housing 44 and into main spool 40 and/or piston 46. According to some embodiments, assembly 73 may serve as a calibration assembly for establishing a neutral position of main spool 40 and/or piston 46 with respect to housing 44. Upon assembly of the electro-hydraulic valve 24, for example, piston 46 may be moved relative to servo spool 42 (i.e., piston 46 may be rotated and/or translated lengthwise relative to servo spool 42) until spiral lands 64*a* and 64*b* of servo spool 42 are positioned over orifices 70 and 72 of piston 46. For example, pin 76 may include an eccentric extension 78 configured to engage groove 74 and adjust the angular position of piston 46 with respect to housing 44 by rotation of pin 76 until spiral lands 64*a* and 64*b* cover orifices 70 and 72. Once piston 46 is positioned in this manner, the position of pin 76 may be fixed, such that the neutral position is established for servo spool 42. According to some embodiments, calibration assembly may be separate from assembly 73.

According to some embodiments, electro-hydraulic valve 24 may include a return mechanism 80 configured to return main spool 40 and/or servo spool 42 to the neutral position, for example, upon loss of power to motor 36. According to some embodiments, return mechanism 80 may include a torsion spring 82 configured to rotate servo spool 42 back to its neutral position, such that spiral lands 64*a* and 64*b* cover orifices 70 and 72. Alternatively, or in addition, electro-hydraulic valve 24 may include a bias assembly 43, including spring 45 operably coupled to main spool 40. Bias assembly 43 may be configured to move main spool 40 to a neutral position, for example, upon loss of pilot supply, regardless of the position of servo spool 42 and/or motor 36 (i.e., the angle of servo spool 42 or step motor 36). For example, spring 45 may be configured to move main spool 40 such that piston 46 is positioned with spiral lands 64*a* and 64*b* covering orifices 70 and 72. Return mechanism 80 may prevent unintended operation of actuator 14 controlled by the electro-hydraulic valve 24 upon loss of power, for example, such that actuator 14 does not drop a load L.

Figure 3:
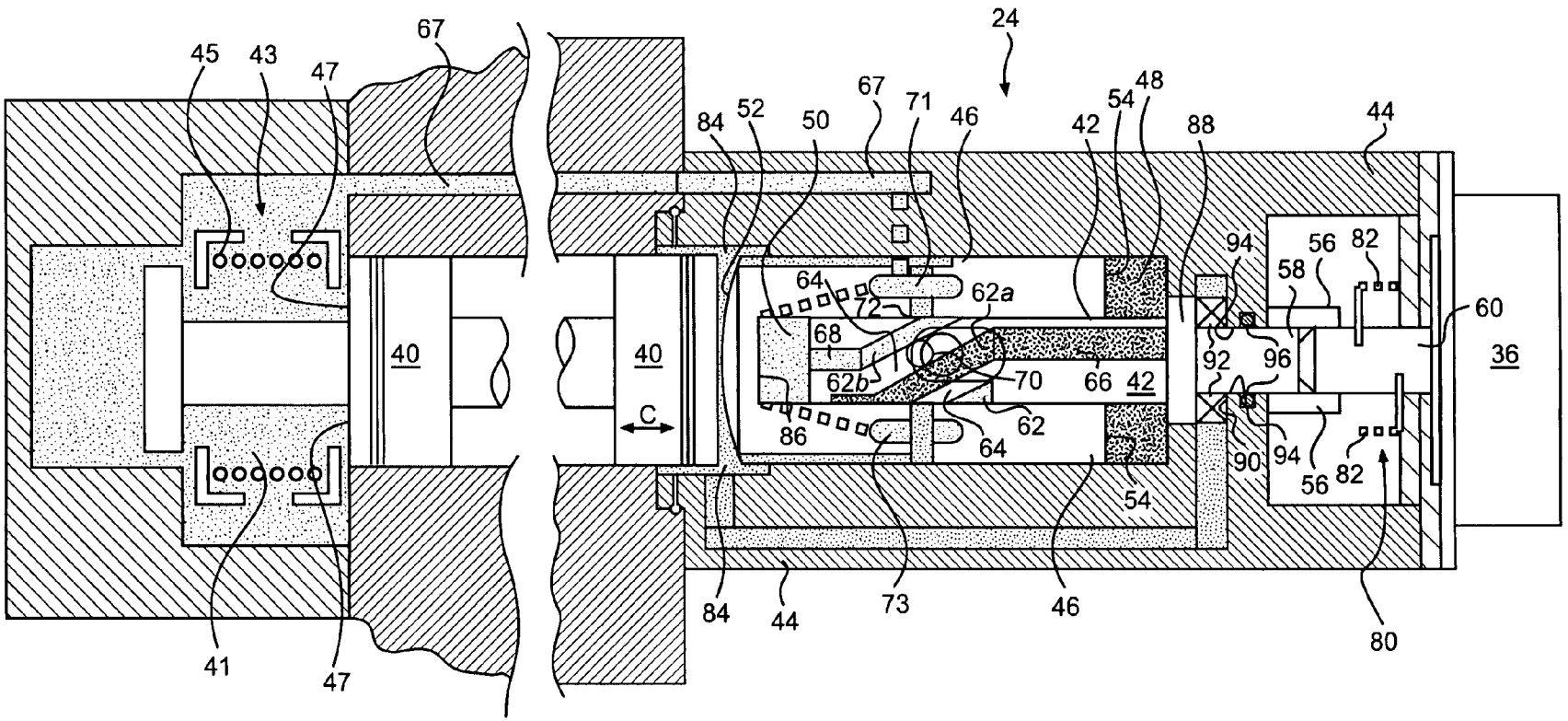
FIG. 3 is a schematic, partial section view of an exemplary embodiment of a valve.

According to some embodiments, for example, the exemplary embodiment of valve 24 schematically depicted in FIG. 3, servo spool 42 may not necessarily include passages located in the interior of servo spool 42. According to the exemplary embodiment depicted in FIG. 3, valve 24 may be a rotary-actuated electro-hydraulic valve. Similar to exemplary valve 24 shown in FIG. 2, exemplary electro-hydraulic valve 24 shown in FIG. 3 includes a main spool 40 controlled by operation of a servo spool 42. According to some embodiments, main spool 40 is operably associated with main spool chamber 41, and the position of main spool 40 may be biased via bias assembly 43, including spring 41. Housing 44 and piston 46 define a first chamber 48 having a surface 54 (e.g., an annular surface). Servo spool 42 and piston 46 define a second chamber 50 having a surface 86. Housing 44, piston 46, and main spool 40 define a third chamber 84 in permanent flow communication with main spool chamber 41 via orifices 71 and 73 and passage 67. Third chamber 84 defines a surface 52.

According to some embodiments, fluid pressure in first chamber 48 acts on surface 54 such that a force on surface 54 pushes on piston 46 to the left (as shown in FIG. 3). Since piston 46 is operably associated with main spool 40, the force on surface 54 acts to move main spool 40 to the left. Fluid pressure in second chamber 50 acts on surface 86 such that a force on surface 86 pushes on piston 46 to the left (as shown in FIG. 3). Since piston 46 is operably associated with main spool 40, the force on surface 86 acts to move main spool 40 to the left. Main spool chamber 41 is in flow communication (e.g., permanent flow communication) with second chamber 84 via, for example orifices 71 and 73 and passage 67. Fluid pressure in main spool chamber 41 acts on surface 47 such that a force on surface 47 pushes main spool 41 to the right (as shown in FIG. 3). The net effective force acting on main spool 40 is the difference between the force acting on surface 47 in main spool chamber 41 and the force acting on surface 86 of second chamber 50. For example, pilot supply pressure is in flow communication with second chamber 50 and main spool chamber 41 (i.e., main spool chamber 41 and second chamber 50 are in flow communication and have equal fluid pressure), and the net force acting on main spool 40 is the difference between the area of surface 47 and the area of surface 86. In the neutral position, the forces acting on main spool 40 to the left and to the right balance one another.

According to some embodiments, for example, the exemplary embodiment shown in FIG. 3, main spool 40 and piston 46 are not rigidly connected to one another. As shown in FIG. 3, first chamber 48 is in flow communication with a reference pressure (e.g., drain to tank 22), and because first chamber 48 is in flow communication with a reference pressure, piston 46 and main spool 40 are pushed toward one another, such that they are operably connected to one another (e.g., piston 46 and main spool 46 tend to move in unison even though they are not rigidly connected to one another). Such a construction may simplify alignment of main spool 40 and piston 46.

Movement of piston 46 may be controlled by operation of servo spool 42, which controls the difference between the pressure in first chamber 48 and the pressure in second chamber 50. Servo spool 42 may be operably coupled to motor 36, for example, a step motor, via a coupling 56 (e.g., an elastic coupling), such that servo spool 42 may be rotated through an angular displacement within piston 46 via the motor 36. For example, servo spool 42 may include an input shaft 58, and motor 36 may include an output shaft 60, and input shaft 58 of servo spool 42 may be coupled directly to output shaft 60 of motor 36 via coupling 56. According to some embodiments (not shown) a gear assembly, for example, a reduction gear assembly, may be provided between motor 36 and servo spool 42.

Servo spool 42 includes one or more spiral grooves 62 defining one or more spiral lands 64. According to some embodiments, a pair of spiral grooves 62 may be located on diametrically-opposed sides of servo spool 42. By virtue of having diametrically-opposed spiral grooves 62, forces between servo spool 42 and piston 46 due to fluid pressure in spiral grooves 62 oppose and substantially offset one another, which may serve to, for example, avoid net side forces on servo spool 42 and/or reduce tendency for servo spool 42 exhibit stickiness of motion with respect to piston 46.

According to the exemplary embodiment shown in FIG. 3, servo spool 42 includes a passage 66 in the form of a groove located on the exterior of servo spool 42. Passage 66 provides flow communication between spiral groove 62*a* and second chamber 50. Servo spool 42 further includes a passage 68 in the form of a groove located on the exterior of servo spool 42. Passage 68 provides flow communication between spiral groove 62*b* and third chamber 84. Spiral groove 62*a* corresponding to passage 66 is configured to provide flow communication between second chamber 50 and a pilot supply of fluid via one or more orifices 70 (e.g., a pair of diametrically-opposed orifices 70). Spiral groove 62*b* corresponding to passage 68 is configured to provide flow communication between third chamber 84 and first chamber 48 via one or more orifices 72 (e.g., a pair of diametrically-opposed orifices 72), which, in turn, are in fluid communication with drain to tank 22. Orifice(s) 70 and orifice(s) 72 are defined by piston 46. Orifice(s) 70 provide flow communication (e.g., permanent flow communication) with pilot supply pressure, and orifice(s) 72 provide flow communication (e.g., permanent flow communication) with a reference pressure (e.g., drain to tank 22).

During exemplary operation of the exemplary embodiment shown in FIG. 3, when servo spool 42 is in a neutral position (i.e., a position resulting in no movement of piston 46 and/or main spool 40), spiral land 64 covers a pair of orifices 70 and a pair of orifices 72 of piston 46. As servo spool 42 rotates (e.g., in a clockwise direction as viewed from the motor-end of valve 24 of FIG. 2), orifices 70 and orifices 72 become increasingly uncovered as spiral land 64 of servo spool 42 moves to the right (as depicted in FIG. 3), such that spiral grooves 62*a* and 62*b* permit flow communication between the pilot supply and second chamber 50 via passage 68, and between first chamber 48 and the drain to tank 22 via passage 66. This causes the pressure in second chamber 50 to increase and the pressure in first chamber 48 to decrease. The difference in pressure between the pressure in second chamber 50 and the pressure in first chamber 48 causes piston 46 to move to the left (as shown in FIG. 3). As piston 46 moves to the left, main spool 40 also moves to the left (as shown by the left end of arrow C), thereby controlling fluid flow to and/or from, for example, actuator 14 that is part of a hydraulic system. According to some embodiments, main spool 40 and piston 46, although operably coupled to one another, are not rigidly coupled to one another for, for example, ease of assembly. Yet main spool 40 and piston 46 tend to move in unison with one another. The leftward movement of piston 46 continues until orifices 70 and orifices 72 in piston 46 are covered again by spiral land 64 of servo spool 42, as piston 46 moves to the left due to the difference between the pressure in second chamber 50 and the pressure in first chamber 48.

As servo spool 42 rotates in a counterclockwise direction (i.e., as viewed from the motor-end of valve 24 of FIG. 3), orifices 70 and orifices 72 become increasingly uncovered as spiral land 64 of servo spool 42 moves to the left (as depicted in FIG. 3), such that spiral grooves 62*a* and 62*b* permit flow communication between the pilot supply and first chamber 48, and between second chamber 50 and the drain to tank 22. This causes the pressure in first chamber 48 to increase and the pressure in second chamber 50 to decrease. The difference in pressure between the pressure in second chamber 50 and the pressure in first chamber 48 causes piston 46 to move to the right (as shown in FIG. 3). As piston 46 moves to the right, main spool 40, which is operably coupled to piston 46, also moves to the right (as shown by direction of the right end of arrow C), thereby controlling fluid flow to and/or from, for example, actuator 14 which is part of a hydraulic system. The rightward movement of piston 46 continues until orifices 70 and orifices 72 in piston 46 are covered again by spiral land 64 of servo spool 42, as piston 46 moves to the right due to the difference between the pressure in second chamber 50 and the pressure in first chamber 48.

As shown in FIG. 3, servo spool 42 may include a land 88, and housing 44 may include a recess 90 configured to receive a bearing 92 and land 88 of servo spool 42. Housing 44 may further include an aperture 94 configured to receive servo spool 42's input shaft 58, which may be operably coupled to motor 36's output shaft 60 via coupling 56 (e.g., an elastic coupling). Aperture 94 may be configured to receive a seal 96. According to some embodiments, land 88 may serve to seal first chamber 48 from a reference pressure (e.g., drain to tank 22). According to some embodiments, in combination with land 88, bearing 92 may serve to take up axial load on servo spool 42 due to, for example, fluid pressure in first chamber 48 and/or second chamber 50.

The exemplary embodiment of valve 24 shown in FIG. 3 may include a step motor, which may operate in a similar manner as described previously herein with respect to FIG. 2, including, for example, operating according to a dithering strategy. The exemplary embodiment shown in FIG. 3 may also include an assembly 73 (e.g., including a calibration assembly) and/or a return mechanism 80 configured to return main spool 40 and/or servo spool 42 to the neutral position, for example, at least similar to those described previously herein.

According to some embodiments, housing 44 may be in the form of a unitary structure that provides a housing for main spool 40 and servo spool 42 (i.e., as distinguished from a valve 24 having a separate housing for a portion of valve 24 including main spool 40 and a separate housing for a portion of valve 24 including servo spool 42). According to some embodiments, main spool 40 and piston 46 may be integrated, such that main spool 40 and piston 46 form a unitary construction, for example, a unitary construction having substantially the same outside diameter. According to some embodiments, rather than servo spool 42 including a land 88, which provides a fluid seal, motor 36 may provide a fluid seal (e.g., motor 36 may include an integrated seal, for example, a pressure-resistant seal). According to some embodiments, output shaft 60 of motor 36 may be integrated with servo spool 42, for example, such that output shaft 60 and servo spool 42 form a unitary structure (e.g., the outer diameter of output shaft 60 and outer diameter of servo spool 42 may be substantially equal).

INDUSTRIAL APPLICABILITY

The disclosed exemplary valves may be applicable for any type of machine including a hydraulic system configured to control fluid flow. For example, the disclosed exemplary valves may be used in association with a vehicle including a hydraulic system having one or more hydraulic actuators configured to perform work. Some examples of hydraulic actuators include, but are not limited to, linear actuators, such as, for example, rod and cylinder actuators, and rotary actuators, such as, for example, hydraulic pumps and hydraulic motors. Some examples of machines that may include such actuators include, but are not limited to, construction vehicles and agricultural vehicles. Such vehicles may include, but are not limited to, tracked vehicles and wheeled vehicles, for example, vehicles having work implements configured to perform a work function, such as, for example, digging, pushing, scraping, lifting, dumping, and/or hoisting. Such functions may be controlled, for example, by controlling fluid flow to and/or from hydraulic actuators. Fluid flow may be controlled, at least in part, by one or more of the exemplary valves disclosed herein.

According to some embodiments of valve 24, valve 24 includes a servo spool 42 and piston 46 located within a housing 44. Servo spool 42 may be configured to control movement of piston 46, which, in turn, controls movement of a main spool 40 of valve 24. Movement of main spool 40 may be configured to control the flow of fluid to an actuator 14, which performs work, for example, applying force to a load. For example, actuator 14 may be a linear actuator, such as, for example, a rod and cylinder assembly configured to extend and retract a rod 34 in response to selective flow of fluid into one or more chambers defined by a piston 28 (see, e.g., FIG. 1). Rod 34 may be operably coupled to a load L, such that extension and retraction of rod 34 results in performance of work against load L. For example, rod 34 may be operably coupled to, for example, a boom, blade, or bucket configured to perform work, such as, for example, raise a load, scrape the earth, and/or carry a load of dirt. Fluid flow to actuator 14 may be controlled by one or more valves 24.

According to some embodiments, servo spool 42 may define one or more spiral grooves 62 and spiral lands 64, along with one or more passages 66 and 68 providing flow communication between a pilot supply and a reference pressure (e.g., drain to tank 22) and one or more of spiral grooves 62. Some embodiments of valve 24 may include a motor 36 operably coupled to servo spool 42 and configured to angularly displace servo spool 42, such that spiral land 64 selectively uncovers and covers orifices 70 and 72 providing flow communication to a pilot supply of fluid and a reference pressure. Servo spool 42, piston 46, and housing 44 may define chambers 48 and 50, and angular displacement of servo spool 42 may serve to open flow communication between chambers 48 and 50, and a pilot supply and a drain to tank 22. Opening fluid flow communication between chambers 48 and 50 and a pilot supply and a drain to tank 22 may serve to create a force imbalance on piston 46 due to differences in fluid pressure in chambers 48 and 50. The force imbalance results in piston 46 translating within housing 44 until orifices 70 and 72 are substantially covered by spiral land 64, such that the force imbalance on piston 46 is dissipated. Since piston 46 is operably coupled to main spool 40, movement of main spool 40 may be controlled by operation of motor 36. Main spool 40 may control the flow of fluid to actuator 14. Thus, by virtue of controlling the operation of motor 36, fluid flow to actuator 14 may be controlled.

The exemplary embodiments of valve 24 may result in improved responsiveness. For example, the embodiments of valve 24 may exhibit a faster response to an operator's commands. Further, exemplary embodiments of valve 24 may exhibit an ability to provide more resolution in response to an operator's commands. Such an improved response may enable an operator to have improved control over an actuator. Moreover, exemplary embodiments of valve 24 may substantially eliminate the effects of hysteresis, such that valve 24 exhibits a more consistent operation. Additionally, exemplary embodiments of valve 24 may not be as susceptible to adverse affects of fluid contamination.

According to some embodiments, exemplary valve 24 operates as what is sometimes referred to as a "position actuator," which are sometimes distinguished from, for example, at least some conventional electric pressure reducing valves, which are sometimes referred to as "pressure actuators." At least some examples of valve 24 may be operated such that if main spool 40 is not located in a desired position, for example, as determined by a step motor angle, orifices 70 and orifices 72 of piston 46 will remain at least partially uncovered and create a pressure imbalance due to the pilot supply until main spool 40 reaches a desired position. This manner of operation may result in rejection of force disturbances, such as, for example, force disturbances caused by flow forces acting on main spool 40.

It will be apparent to those skilled in the art that various modifications and variations can be made to the disclosed systems and methods. Other embodiments will be apparent to those skilled in the art from consideration of the specification and practice of the disclosed systems and methods. It is intended that the specification and examples be considered as exemplary only, with a true scope being indicated by the following claims and their equivalents.

What is claimed is:

1. A valve for controlling fluid flow in a fluid system, the valve comprising:

a housing;

a servo spool positioned at least partially within the housing, the servo spool including a substantially cylindrical portion, the substantially cylindrical portion defining a spiral groove extending around the substantially cylindrical portion to define a spiral land;

a piston positioned at least partially within the housing and at least partially surrounding the substantially cylindrical portion of the servo spool, the piston defining an orifice configured to provide flow communication to a supply of pressurized fluid and an orifice configured to provide flow communication to a portion of the fluid system exterior to the valve;

a main spool operably coupled to the piston, the main spool configured to control flow of fluid in the fluid system;

a first chamber at least partially defined by at least one of the housing, the servo spool, and the piston;

a second chamber at least partially defined by at least one of the housing, the servo spool, and the piston;

wherein the first chamber is located such that force due to fluid pressure in the first chamber is configured to move the piston in a first direction, and the second chamber is located such that force due to fluid pressure in the second chamber is configured to move the piston in a second direction, and wherein the spiral groove and spiral land are configured such that angular displacement of the servo spool results in providing flow communication between the first chamber and the portion of the fluid system exterior to the valve via one of the orifices and between the supply of pressurized fluid and the second chamber via another of the orifices, such that fluid pressure in the first chamber is changed and fluid pressure in the second chamber is changed, resulting in a force imbalance on the piston, thereby moving the piston and the main spool in one of the first direction and the second direction.

2. The valve of claim 1, including a motor operably coupled to the servo spool, the motor configured to angularly displace the servo spool.

3. The valve of claim 2, wherein the motor includes an output shaft and the servo spool includes an input shaft, and the output shaft is coupled to the servo spool via a coupling.

4. The valve of claim 2, wherein the motor is a step motor.

5. The valve of claim 1, wherein the servo spool includes a pair of spiral grooves located on diametrically-opposed sides of the substantially cylindrical portion of the servo spool.

6. The valve of claim 1, wherein the servo spool includes at least two spiral grooves, and the servo spool includes a passage extending from one of the spiral grooves to the supply of pressurized fluid and a passage extending from another of the spiral grooves to the portion of the hydraulic system exterior to the valve.

7. The valve of claim 6, wherein the passages are grooves defined by the exterior surface of the servo spool.

8. The valve of claim 1, wherein the servo spool and the main spool are rigidly coupled to one another to form a unitary structure.

9. The valve of claim 1, wherein the servo spool and the main spool are not rigidly connected to one another.

10. The valve of claim 1, including a calibration pin extending into the housing, the calibration pin including an eccentric portion configured to engage a groove defined by the piston.

11. The valve of claim 1, including a return mechanism configured to bias the servo spool toward a neutral position.

12. The valve of claim 11, wherein the return mechanism includes a torsion spring operably coupled to the servo spool.

13. The valve of claim 11, wherein the return mechanism includes a spring operably coupled to the main spool.

14. The valve of claim 1, wherein the supply of pressurized fluid is a pilot supply of fluid and the servo spool is a pilot spool.

15. A hydraulic system comprising:

a fluid pump configured to pressurize fluid in the hydraulic system;

an actuator configured to operate in response to receipt of pressurized fluid; and a valve configured to control flow of pressurized fluid between the pump and the actuator, the valve including, a housing;

a servo spool positioned at least partially within the housing, the servo spool including a substantially cylindrical portion, the substantially cylindrical portion defining a spiral groove extending around the substantially cylindrical portion to define a spiral land;

a piston positioned at least partially within the housing and at least partially surrounding the substantially cylindrical portion of the servo spool, the piston defining an orifice providing flow communication to a supply of pressurized fluid and an orifice providing flow communication to a portion of the hydraulic system exterior to the valve;

a main spool operably coupled to the piston, the main spool configured to control fluid flow to the actuator;

a first chamber at least partially defined by at least one of the housing, the servo spool, and the piston;

a second chamber at least partially defined by at least one of the housing, the servo spool, and the piston;

wherein the first chamber is located such that force due to fluid pressure in the first chamber is configured to move the piston in a first direction, and the second chamber is located such that force due to fluid pressure in the second chamber is configured to move the piston in a second direction, and wherein the spiral groove and spiral land are configured such that angular displacement of the servo spool results in providing flow communication between the first chamber and the portion of the hydraulic system exterior to the valve via one of the orifices and between the supply of pressurized fluid and the second chamber via another of the orifices, such that fluid pressure in the first chamber is changed and fluid pressure in the second chamber is changed, resulting in a force imbalance on the piston, thereby moving the piston and the main spool in one of the first direction and the second direction.

16. The hydraulic system of claim 15, wherein the pump is a main pump, and further including a pilot pump configured to provide a pilot supply of pressurized fluid to the valve, wherein the pilot pump provides the supply of pressurized fluid to the servo spool, and the main spool controls flow of pressurized fluid between the main pump and the actuator.

17. The hydraulic system of claim 15, wherein the valve includes a motor operably coupled to the servo spool.

* * * * *